US008297885B2

(12) United States Patent
Grinberg et al.

(10) Patent No.: US 8,297,885 B2
(45) Date of Patent: Oct. 30, 2012

(54) METHOD OF ERECTING A BUILDING STRUCTURE IN A WATER BASIN

(75) Inventors: Vyacheslav Grinberg, Nesher (IL); Ilya Davidovich, Nesher (IL); Samuil Yakhins, Kiryat Ata (IL); Konstantin Kovler, Nesher (IL)

(73) Assignee: Technion Research and Development Foundation Ltd., Haifa (IL)

( * ) Notice: Subject to any disclaimer, the term of this patent is extended or adjusted under 35 U.S.C. 154(b) by 371 days.

(21) Appl. No.: 12/432,171

(22) Filed: Apr. 29, 2009

(65) Prior Publication Data

US 2009/0324341 A1 Dec. 31, 2009

Related U.S. Application Data

(60) Provisional application No. 61/049,302, filed on Apr. 30, 2008.

(51) Int. Cl.
*E02D 23/02* (2006.01)

(52) U.S. Cl. ..... 405/205; 405/13

(58) Field of Classification Search ..... 405/13, 405/203–205

See application file for complete search history.

(56) References Cited

U.S. PATENT DOCUMENTS

| | | | | | |
|---|---|---|---|---|---|
| 3,793,842 | A * | 2/1974 | Lacroix | 405/210 |
| 4,425,055 | A * | 1/1984 | Tiedemann | 405/217 |
| 4,478,537 | A * | 10/1984 | Birdy et al. | 405/217 |
| 5,354,151 | A * | 10/1994 | Giannesini | 405/205 |
| 5,613,808 | A * | 3/1997 | Fitzpatrick | 405/217 |
| 5,803,668 | A * | 9/1998 | Seki et al. | 405/204 |
| 5,833,397 | A * | 11/1998 | Horton, III | 405/204 |
| 6,082,931 | A * | 7/2000 | Hopper | 405/218 |
| 6,234,714 | B1 * | 5/2001 | Chattey | 405/8 |
| 6,276,876 | B1 * | 8/2001 | Bone et al. | 405/205 |
| 6,390,733 | B1 * | 5/2002 | Burbage et al. | 405/203 |
| 2002/0110421 | A1 * | 8/2002 | Fowler | 405/13 |

* cited by examiner

*Primary Examiner* — Tara Mayo-Pinnock

(74) *Attorney, Agent, or Firm* — William H. Dippert; Eckert Seamans Cherin & Mellott, LLC

(57) ABSTRACT

The present invention provides a method of creating a building structure to be installed on a basin floor wherein the base for erecting the structure would be an element of such a block and this block would be placed on the basin floor in such a way, and would be fixed in position relative to it in such a manner, that this base could be used as a foundation for stationary, large-sized heavy structures and also to ensure the possibility of using the block elements as members of the structure being erected and thus to increase the economic efficiency of the method.

9 Claims, 9 Drawing Sheets

METHOD OF ERECTING A BUILDING STRUCTURE IN A WATER BASIN

CROSS-REFERENCE TO RELATED APPLICATION

This application is based upon and claims priority of commonly assigned U.S. Provisional Patent Application Ser. No. 61/049,302, filed Apr. 30, 2008, which is incorporated herein in its entirety.

FIELD OF THE INVENTION

The invention relates to the field of construction, more specifically, to erection of individually located large building structures such as residential buildings, hotel complexes, industrial projects, airdromes, artificial islands etc., on the sea floor in shallow water or in another water basin.

BACKGROUND OF THE INVENTION

There is a widely known method of creating building structures in water wherein a preset area of a water basin is filled with some inert material to exceed the water level and then a building structure is erected on the surface of the formed island used as a base.

However, this method is highly labour-consuming and not economical enough since it requires great quantities of inert material and loading the material on floating facilities and delivering it to a building site.

In addition, this method requires the creation of special consolidation to impede landslide and wash-out of the material as well as its sliding down below the water level.

There is a known method of creating building structures in water (U.S. Pat. No. 4,511,288), wherein ballastable modules are floated to a preset area of a water basin, then they are submerged in turn, each module is placed on top of a preceding one. Then a structure is erected on a module projecting from water, this module used as a base.

The main drawback of such method is the impossibility of using it for erecting stationary, large-sized heavy structures. This is determined by the fact that hollow ballastable modules can neither be used as a foundation for such a structure, nor carry such a foundation. Therefore in practice this method is only used for creating temporary structures intended, for example, for locating drilling rigs, platforms, for receiving aircraft and for locating other structures of this sort.

In addition, this method is not economical enough since it requires the use of great quantities of excessive metal (material of ballastable modules) which is of no direct relation to the structure being created.

Another drawback is the necessity of connecting the modules with one another under water which complicates the method significantly.

And, finally, availability of several modules placed one on top the other affects significantly the reliability of the structure when erected at seismically dangerous areas, at water area subject to heavy sea-ways and also in cases when subsidence of the sea floor is possible.

There is a known method of creating building structures in water (EP No. 0199690) wherein a pontoon is floated to a preset area of the water basin, the pontoon height exceeding the water depth in this area. Then the pontoon is submerged and its upper (projecting from water) surface can be used as a base for erecting the structure.

Reliability of such a structure in contrast to the one created by the preceding method is considerably higher and, besides, is free of the drawbacks connected with the necessity of implementing under-water work on connecting the modules with each other. However all other drawbacks still exist.

There is a known method of creating building structures in water (EP No. 0800600) wherein a pan-shaped block is floated to a preset area of the water basin, this block consisting of a bottom, a deck located above the bottom, and walls hermetically embracing the bottom around its perimeter. Then the block is submerged onto the basin floor by way of filling it with water. The distance between the deck and block bottom is so selected that after the block is submerged onto the bottom, the deck remains above the water level. Then the structure is erected on the deck used as a base.

This method, as well as the two preceding ones, cannot be used for creating stationary, large-sized heavy structures since the deck itself can neither be used as a foundation for such structures, nor carry such a foundation.

In addition, this method is not economical enough since it requires the use of great quantities of excessive material (under-water portion of the pan-shaped block) which is of no direct relation to the structure being created.

There is a known method of creating a building structure wherein piles are first driven into the sea floor. Then a foundation is installed on the piles, and after that the structure is erected.

A drawback of this method is its high labour consumption and low economic efficiency determined by necessity of creating a foundation and erecting all the members of the structure in this case the work is implemented from floating facilities, often under water.

SUMMARY OF THE INVENTION

An object of the invention is the task of finding a method of creating a building structure to be installed on the basin floor wherein the base for erecting the structure would be an element of such a block and this block would be placed on the basin floor in such a way, and would be fixed in position relative to it in such a manner, that this base could be used as a foundation for stationary, large-sized heavy structures and also to ensure the possibility of using the block elements as members of the structure being erected and thus to increase the economic efficiency of the method.

The set task is solved in such a way that a prefabricated pan-shaped block is floated to a preset water site where the structure is to be created. The block consists of a base member-a bottom and walls embracing hermetically the base member around its perimeter and forming working area. The depth of water site is less than the height of the block. The block is submerged onto the basin floor by means of filling with water at least a part of the working area, and as a result has the parts located above water level. Then the submerged block is fixed relative the basin floor, the water is removed from the zone where the construction work should be perform and the building structure is erected on the base member.

The present invention will be understood more fully from the detailed description given herein below and from the accompanying drawings of the preferred embodiment of the invention which, however, should not be construed as exhaustive to the invention but are for explanation and understanding only.

BRIEF DESCRIPTION OF THE DRAWINGS

The essence of the invention is illustrated by drawings which are as follows.

DETAILED DESCRIPTION OF THE PREFERRED EMBODIMENTS

The building structure is created in the following way.

Figure 1:
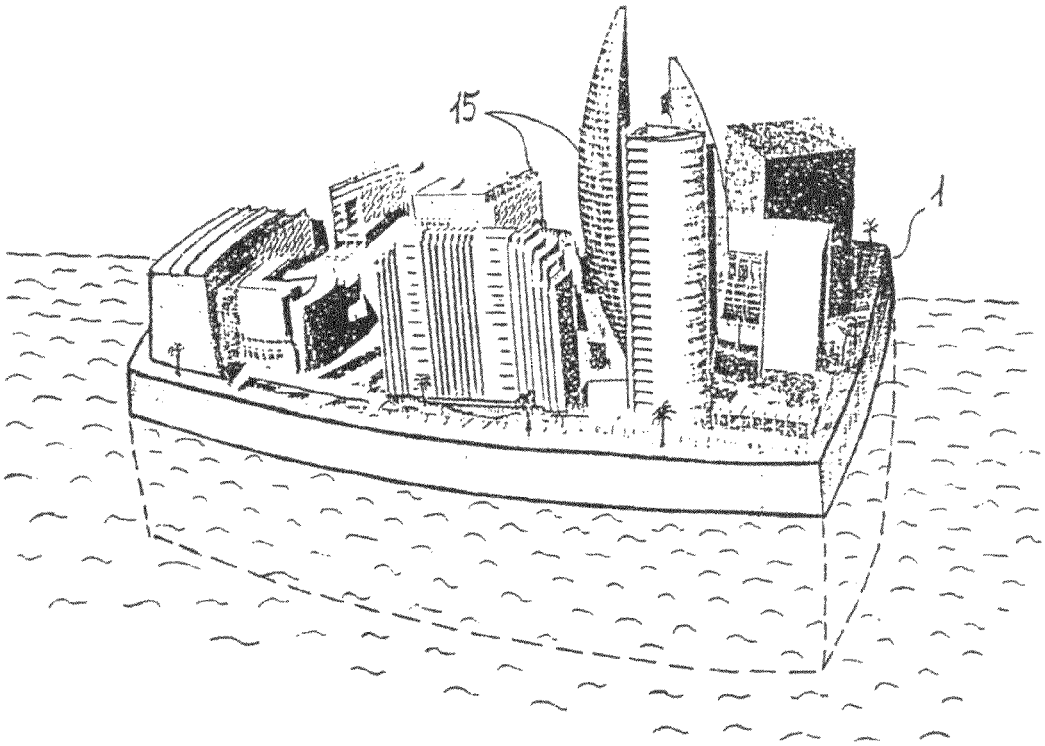
FIG. 1 shows the general view of the building structure in water, according to the present invention.
Figure 4:
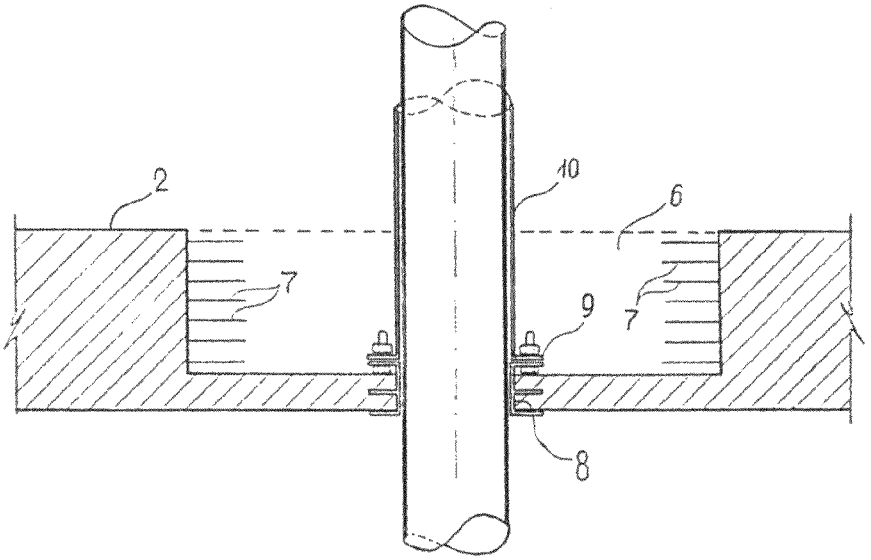
FIG. 4—unit A in FIG. 3, before dismantling the pipes and concrete placement around the pile head, enlarged.
Figure 5:
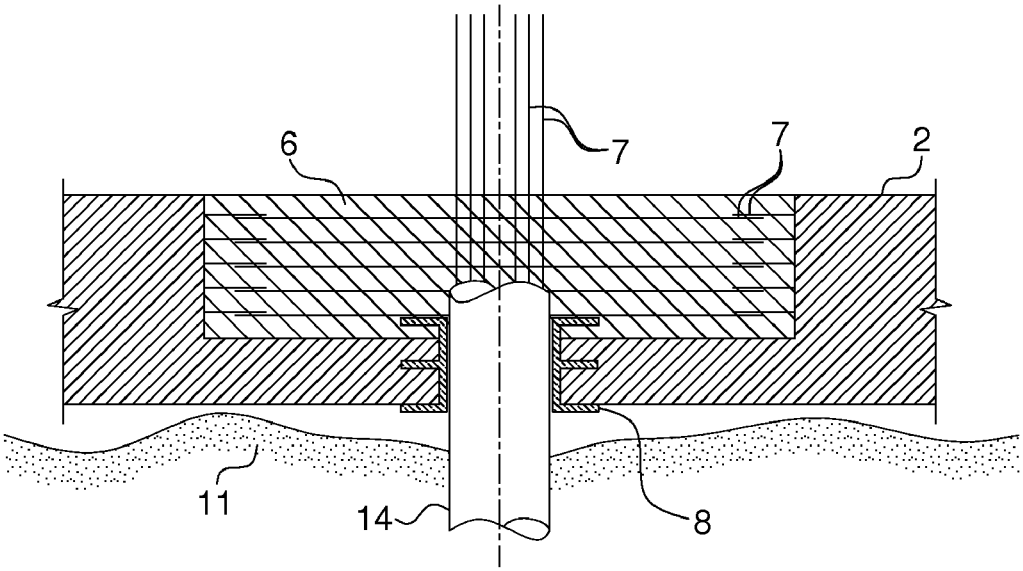
FIG. 5—unit A in FIG. 3 after dismantling the pipes and concrete placement around the pile head, enlarged.
Figure 6:
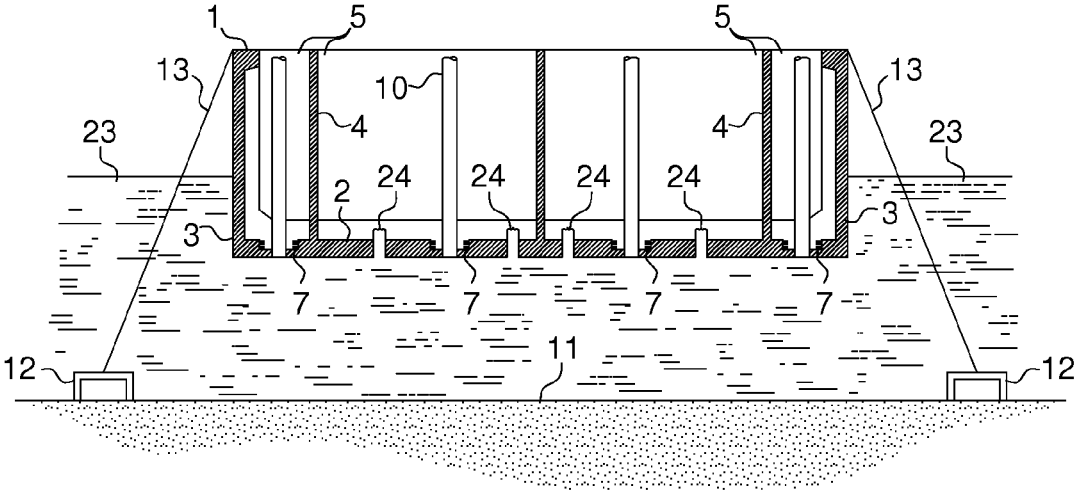
FIG. 6-9—stages of erecting a building structure, according to the present invention.

Reinforced-concrete pan-shaped floating block 1 (FIG. 1) is prefabricated at a factory. Block 1 comprises a base member-a bottom which is essentially one-piece bedplate 2 (FIG. 2, 3), walls 3 that embrace hermetically bedplate 2 around its perimeter and internal upright water-tight partitions 4 dividing the working area between walls 3 into individual sections 5. In one version of embodiment the invention (not shown) partitions 4 are absent. Made in bedplate 2 over its entire area there grooves 6 (FIG. 4, 5) with reinforcing bars 7. Made in grooves 6 are through holes (not shown). In each of these hole branch pipe 8 is concreted with flange 9 located in groove 6. Upright process pipes 10 are connected with branch pipes 8 by means of flanges 9. Height "H" of the block (FIG. 6-9), in particular of walls 3, partitions 4 and process pipes 10 exceeds the water depth "h" at water site 23 where building structure 15 (FIG. 1) is to be erected. Dimensions and configuration of bedplate 2 and walls 3 as well as the dimensions, configuration and place of installation of the partitions are so selected that the maximum number of these elements could be used as the members of the structure erected.

Figure 3:
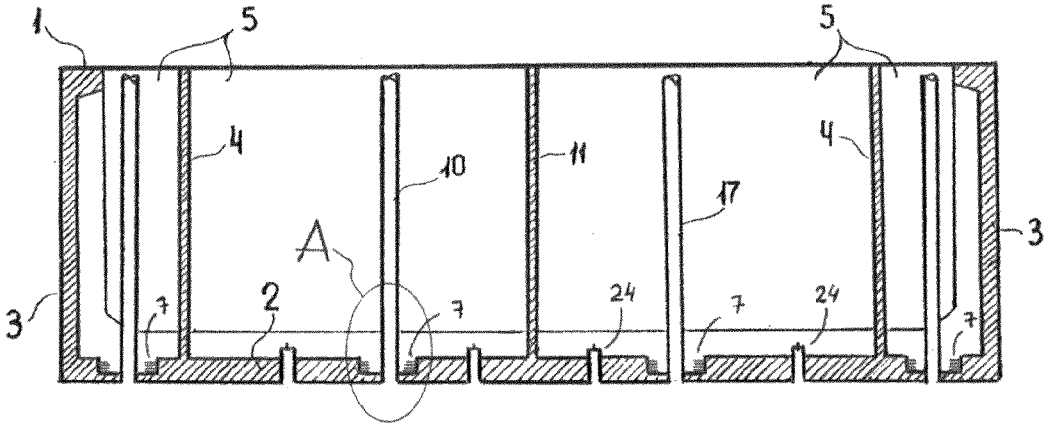
FIG. 3—section III-III in FIG. 2.
Figure 7:
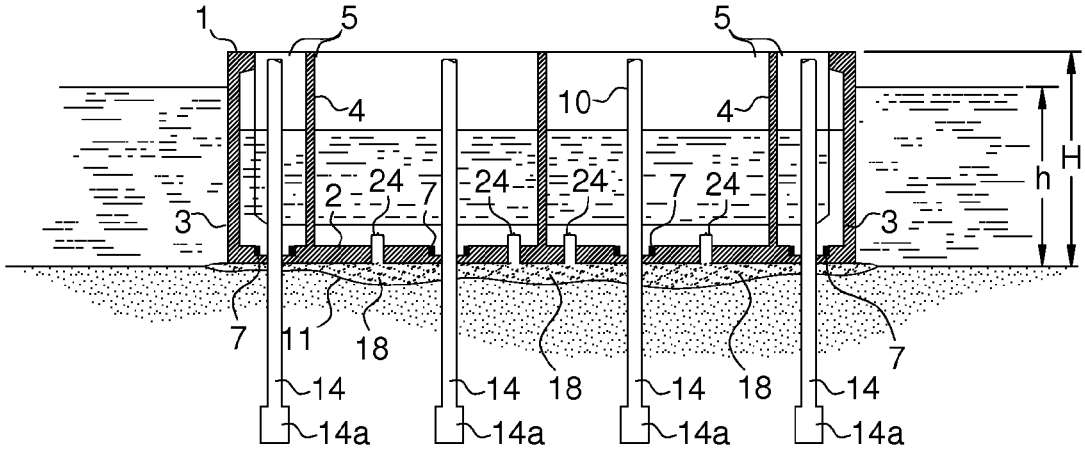

Block 1 (FIG. 3) is floated to preset site 23 (FIG. 6) of the water basin where the structure is to be erected. Then block 1 is secured to basin floor 11 by means of anchors 12 through ropes 13 to provide a required orientation of the block. After that those of the sections 5 where the erection of the structure is not planned at the first stage are filled with water by any of known methods. In so doing the number of sections 5 to be filled with water should be such that under the weight of water, block 1 would submerge and rest on basin floor 11, with bedplate 2 on the basin floor (FIG. 7). Then free spaces 18 between basin floor 11 and bedplate 2 filled up with filler material, e.g. concrete or inert aggregates through openings 24.

In one version of the realization of the method of the block submergence can be provided by filling one part of the sections 5 with water and another part—with inert material with a high specific weight, say, with sand. It is expedient that this inert material could be used as building material in erecting the structure.

In one more version submergence can be provided by filling every single section 5.

To increase reliability of block 1 fixation against its possible displacement relative to basin floor 11 and also against its possible further submergence into the ground, piles 14 (FIG. 8) through pipes 10 (FIG. 4, 5) are installed into the ground by any of known methods. After that pipes 10 are dismantled and the grooves with the pile heads are concreted (made one-piece with the bottom). Then water is pumped from the block.

Figure 10:
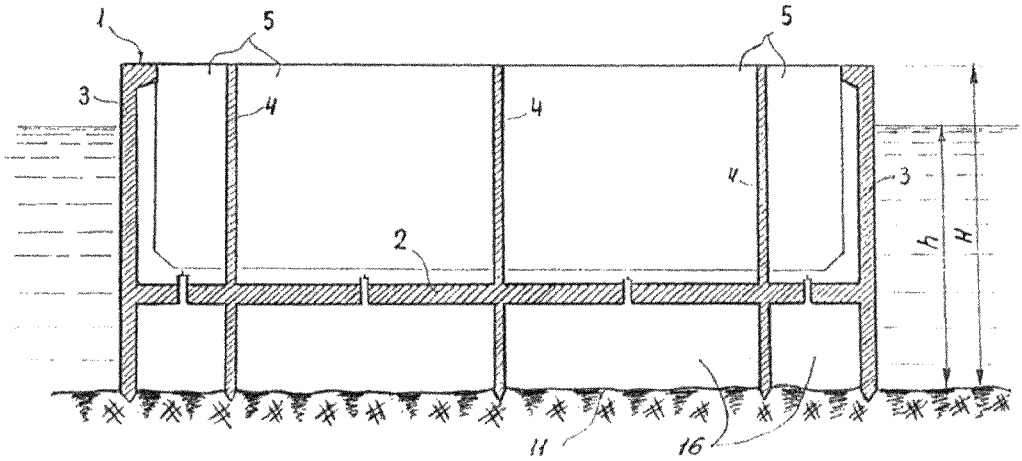
FIG. 10—section III-III in FIG. 2, another version of the block fixation relative to the basin bottom.

In one version the increase of reliability of block 1 fixation against its possible displacement relative to basin floor 11 is achieved not with the aid of process pipes 10 and piles 14. In this version walls 3 (FIG. 10) are prefabricated at a factory in such a way that they extend below the level of bedplate 2 location around its entire perimeter. When such a block is submerged onto the basin floor closed cavity 16 is formed between basin floor 11 and bedplate 2. Creation of one or several closed cavities 16 is possible not around the entire perimeter of bedplate 2 but under its individual sections. This is achieved by making closed projections on the bedplate, say, circular-shaped ones (not shown) on its side facing the basin floor. Reliable fixation of block 1 against possible displacements is achieved in this case by pumping water from closed cavity to engender vacuum in it.

Figure 11:
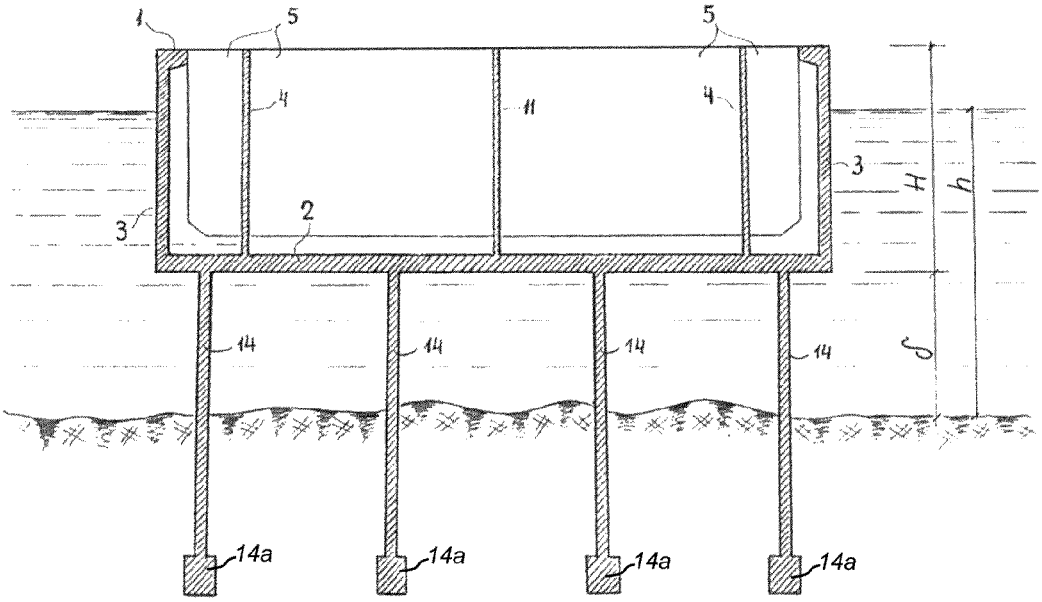
FIG. 11—another version of embodiment of the invention.

In one more version related to the use of piles 14 (FIG. 11) block 1 may be submerged not to a full depth. In this case bedplate 2 is located on said piles with gap (дельта) relative to basin floor 11.

Figure 9:
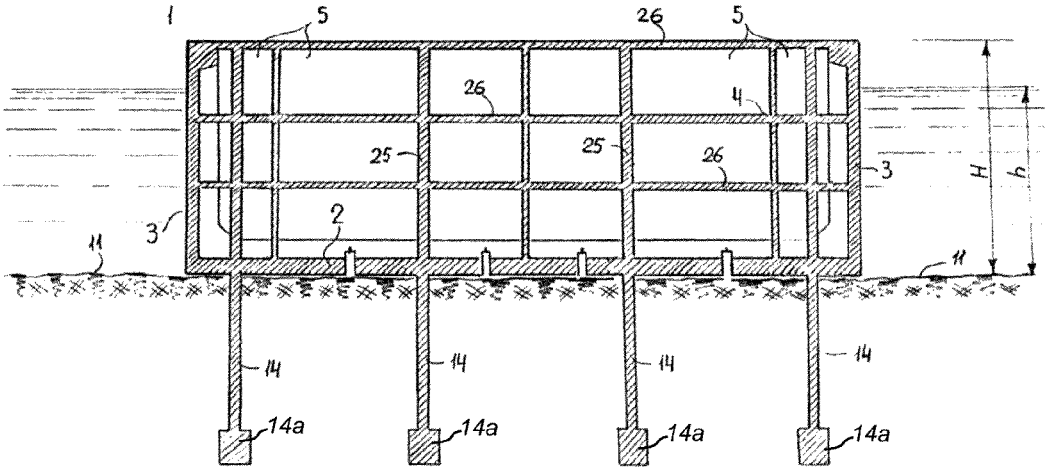

Erection of structure 15 is started in sections not filled with water (in the case, when such sections exist). FIG. 9 shows the parts of the said erected structure—columns of the skeleton 25 and the floors 26. After the weight of the structure erected exceeds the value of the buoyancy force acting on the block, water is pumped from the sections and the structure erection is completed. Ropes 13 can be removed at any moment after a reliable fixation of the structure erected or being erected relative to the basin floor has been ensured.

Figure 8:
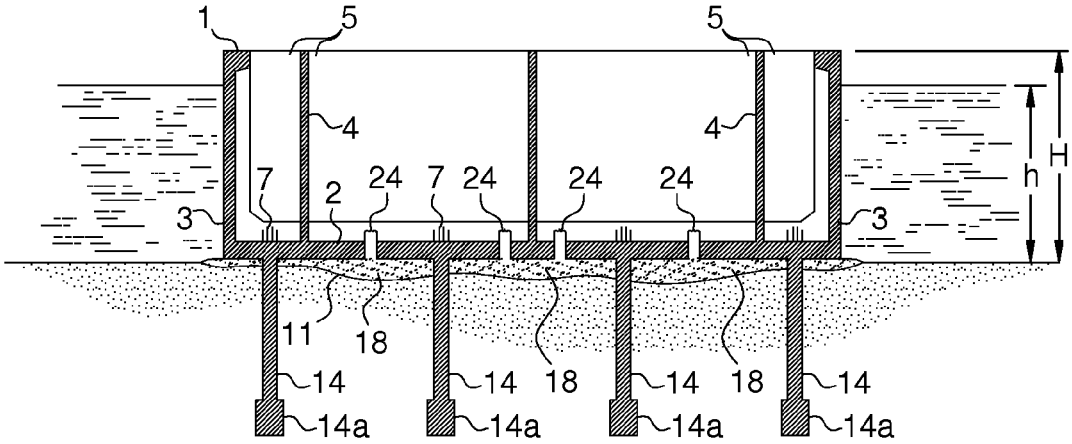

In one version of embodiment of the invention the lower parts of piles 14 are fixed in addition in the ground so as they are restrained from the displacement upward caused, for example, by the buoyancy force of water, Such fixation can be performed by one of the known methods, for example, by means of anchoring parts of the pile having a thicker cross-section in the bottom part (FIG. 8, 9).

In one more version of embodiment of the invention, erection of structure 15 after filling entire block 1 or part of its sections 5 with water is started only on the block portion projecting from water (not shown). In this version, similar to the one described above, after the weight of the structure erected has reached the value exceeding that of the buoyancy force acting on the block, water is pumped from the sections and the structure erection is completed.

Figure 2:
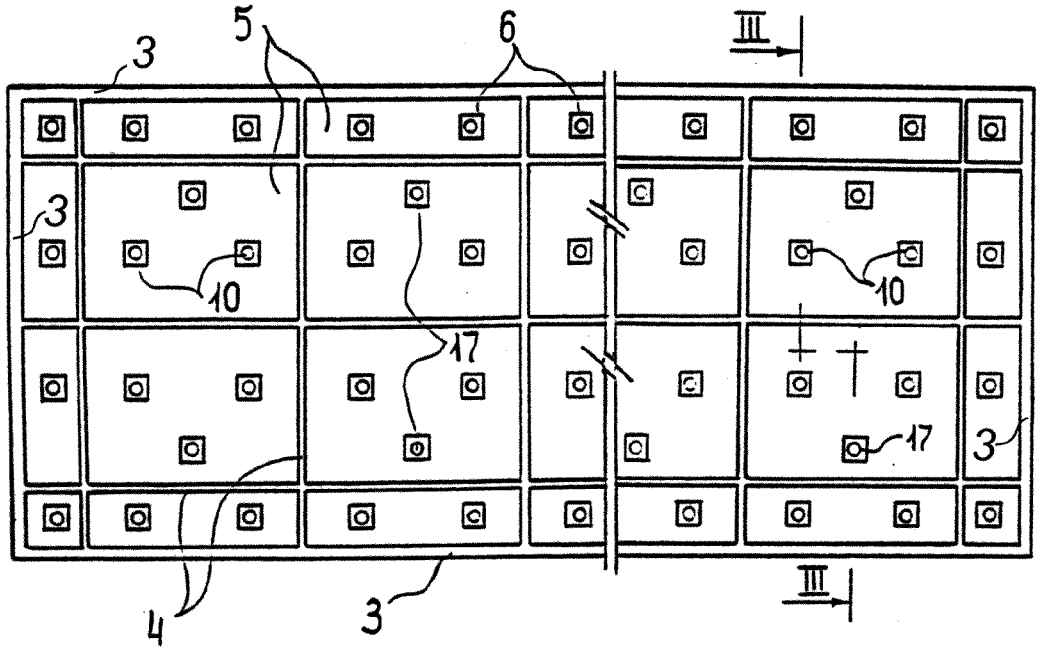
FIG. 2—general view of the floating block, top view.

In another version, through holes are made over the entire area of bedplate 2, may be installed communication pipes 17 (FIG. 2, 3). These pipes are similar to afore-described process pipes 10. The use of communication pipes allows additionally to conduct, if necessary, various activities in the ground, e.g. drilling, geological survey and others.

Figure 12:
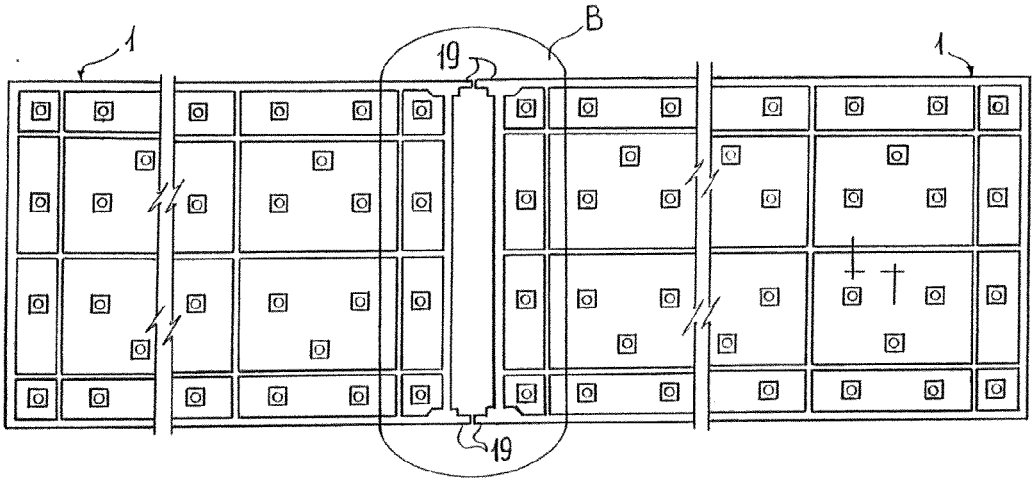
FIG. 12—general view of several blocks connected with each other, top view.
Figure 13:
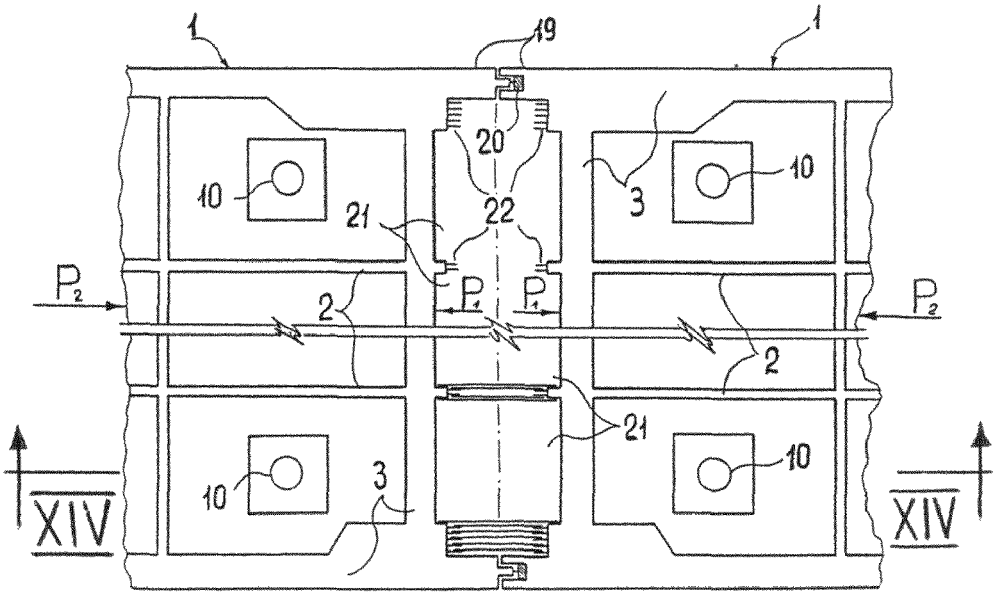
FIG. 13—unit B in FIG. 12, enlarged.
Figure 14:
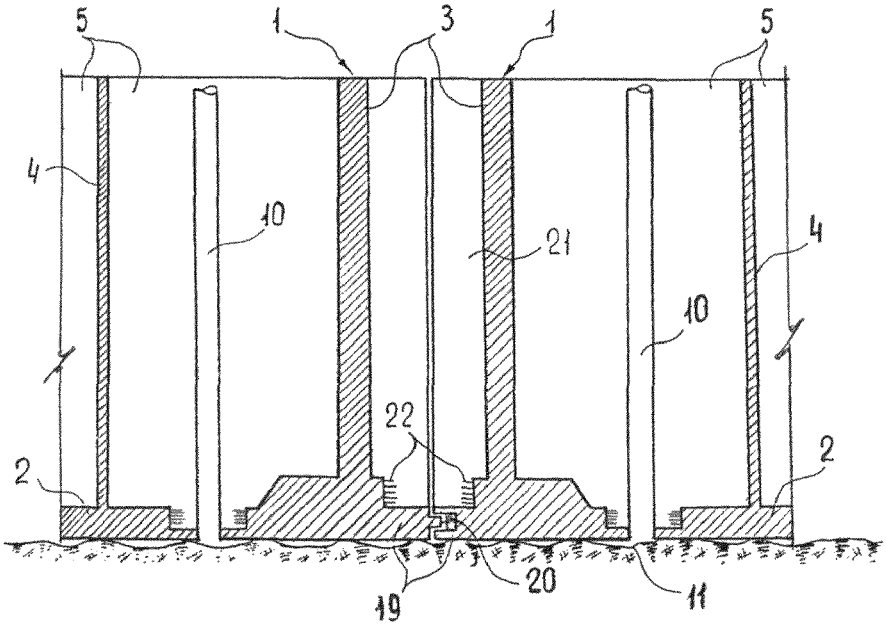
FIG. 14—section XIV-XIV in FIG. 13.

If it is necessary to create building structures with the area larger to such a degree that one block does not allow to solve this problem, several similar blocks are used which are jointed with each other. In this case blocks 1 (FIG. 12-14) are taken which have projections 19 with seals 20 on walls 3 of each of them. These projections located on the external sides of walls 3 and are of such shapes, that they can form together with projections 19 of adjacent blocks, cavities 21 with reinforcing bars 22, these cavities closed below the water level. First of all the first block is submerged onto basin floor 11 and fixed in position. Then the next block is submerged, brought to the first block so that, when butt-jointed, the blocks form said cavities 21. Temporary fixation of blocks 1 relative to one another is implemented by means of well-known appliances. After that water is pumped out from cavities 21 with a speed exceeding the speed of water entering through seals 20. As a result of this pressure P1 on the walls from the cavity side sharply decreases and blocks 1 become tightly pressed against each other due to the pressure P2 of water. Then cavities 21 are concreted.

Various versions of realizing the proposed method within the claims are possible differing from those described above by the absence of partitions 4 in prefabricated block 1 or, on the contrary, by the availability in it of additional, differently oriented partitions which can be used as members of the structure erected, and also differing from the afore-described in elements and units and materials ensuring the implementation of this or that operation, method, in a technique of connecting the blocks with each other, etc.

The proposed method is highly economical since it allows to fabricate at factories, i.e. with minimum labour consumption, floatable blocks with the maximum number of elements (bedplates, upright and horizontal partitions, strengthening ribs, beams, tunnels for running communications, etc.) which are the members of the structures being erected. In this case the floating block is a means of transporting said pre-erected elements of the structures to a preset area of a water basin and at the same time is a zero cycle of construction of planned structures.

This method can be used for creating stationary, large-sized heavy structures practically of any dimensions and with no limitation to the weight, since a foundation of these structures are represented by monolythic concrete plates, resting on the basin floor and fixed reliably against displacement and submergence into the ground.

Although the invention has been described and illustrated with a certain degree of particularity, it is understood that the present disclosure has only been made by way of example, and that various modifications thereof may be resorted to by those skilled in the art without departing from the spirit and scope of the invention, as hereinafter claimed.

What is claimed:

1. A method of erecting a building structure on a water basin, the water basin having a water level and a basin floor and located in a preset site having a site depth, the method comprising:

floating at least one prefabricated pan-shaped block to the preset site, wherein said block has a height higher than the site depth, and wherein said block comprises a base member having a perimeter, a bottom, and walls that embrace said perimeter in a manner to resist the introduction of air or water to form a working area;

submerging said block onto the basin floor by filling at least a part of said working area with water;

fixing said block on the basin floor such that at least part of said block is located above the water level;

removing water from parts of the working area;

erecting a building structure on said base member wherein the building structure is erected on the parts of the working area where the water was removed;

fixing said block against a displacement relative to the basin floor and against further submergence into the ground; and securing upright process pipes having a height exceeding said site depth and spaced over said working area through holes of said base member, by installing piles into the ground through said pipes and dismantling said pipes.

2. The method according to claim 1 wherein:

said block comprises water-tight partitions having a height exceeding said site depth, said partitions dividing said working area into individual sections;

said submerging said block onto said basin floor comprises filling at least a part of said individual sections with water; and wherein said erecting a building structure comprises erecting at least a portion of said building structure in at least another part of said individual sections that are unfilled such that the weight of said block and said at least a portion of said building structure exceeds the value of a buoyancy force acting on said block, removing water from said at least a part of said individual sections, and erecting a building structure on said block.

3. The method according to claim 1 wherein said fixing said block on the basin floor comprises constructing a part of said building structure on block portions projecting out of water until the weight of said part exceeds a buoyancy force acting on said block.

4. The method according to claim 1, wherein said installing piles into the ground comprises fixing lower parts of said piles into the ground such that said piles are restrained from said displacement upward.

5. The method according to claim 1 further comprising extending said block walls below said base member such that said walls form a closed cavity between the basin floor and said base member; and pumping water from said closed cavity to engender vacuum within said cavity.

6. The method according to claim 1, wherein said block elements are used as the members of said building structure to be erected.

7. The method according to claim 1, wherein said block comprises upright pipes having a height that exceeds the site depth, the method further comprising installing said pipes between said walls and rigidly securing said block through pipes and holes located in said base member.

8. A method of erecting a building structure on a water basin, the water basin having a water level and a basin floor and located in a preset site having a site depth, the method comprising:

floating at least one prefabricated pan-shaped block to the preset site, wherein said block has a height higher than the site depth, and wherein said block comprises a base member having a perimeter, a bottom, and walls that embrace said perimeter in a manner to resist the introduction of air or water to form a working area;

submerging said block onto the basin floor by filling at least a part of said working area with water;

fixing said block on the basin floor such that at least part of said block is located above the water level;

removing water from parts of the working area; and erecting a building structure on said base member wherein the building structure is erected on the parts of the working area where the water was removed;

wherein said floating at least one prefabricated block comprises connecting walls of said at least one block that is pan-shaped to walls of an adjacent pan-shaped block and wherein said at least one block comprises projections with seals located on external sides of said walls shaped to be combined with adjacent projections of an adjacent block and forming closed cavities, the method further comprising submerging and fixing said at least one pan-shaped block and at least one adjacent block onto said basin floor such that closed cavities are formed below water level; and pumping water from said cavities at a speed that exceeds the speed of water entering through said seals.

9. The method according to claim 8, wherein pumping water from said cavities further comprises concreting said cavities.

* * * * *